US011091946B2

(12) United States Patent
Wu

(10) Patent No.: US 11,091,946 B2
(45) Date of Patent: Aug. 17, 2021

(54) SPRING HINGE BASE STRUCTURE

(71) Applicants: JYI HSING ENTERPRISE CO., LTD., Chang Hwa (TW); Chun-Yu Wu, Chang Hwa (TW)

(72) Inventor: Chun-Yu Wu, Chang Hwa (TW)

(73) Assignees: JYI Hsing Enterprise Co., Ltd., Chang Hwa (TW); Chun-Yu Wu, Chang Hwa (TW)

( * ) Notice: Subject to any disclaimer, the term of this patent is extended or adjusted under 35 U.S.C. 154(b) by 0 days.

(21) Appl. No.: 16/801,935

(22) Filed: Feb. 26, 2020

(65) Prior Publication Data

US 2020/0190881 A1 Jun. 18, 2020

Related U.S. Application Data

(63) Continuation-in-part of application No. 16/212,685, filed on Dec. 7, 2018, now abandoned.

(51) Int. Cl.

| | |
|---|---|
| ***E05F 1/12*** | (2006.01) |
| ***E05D 3/12*** | (2006.01) |
| ***E05D 3/02*** | (2006.01) |
| ***E05D 11/06*** | (2006.01) |
| ***E05F 5/06*** | (2006.01) |
| ***E05F 1/10*** | (2006.01) |

(52) U.S. Cl.

CPC ..... *E05F 1/1215* (2013.01); *E05D 3/022* (2013.01); *E05D 3/12* (2013.01); *E05D 11/06* (2013.01); *E05F 1/1025* (2013.01); *E05F 5/06* (2013.01); *E05Y 2201/218* (2013.01); *E05Y 2201/484* (2013.01); *E05Y 2201/492* (2013.01); *E05Y 2800/674* (2013.01); *E05Y 2800/676* (2013.01); *E05Y 2900/132* (2013.01); *E05Y 2900/40* (2013.01)

(58) Field of Classification Search

CPC ..... E05F 1/12; E05F 1/1207; E05F 1/1215; E05F 1/123; Y10T 16/53862; Y10T 16/5388; Y10T 16/53888; Y10T 16/5389; E05D 3/12

USPC ..... 16/299, 304, 307, 308

See application file for complete search history.

(56) References Cited

U.S. PATENT DOCUMENTS

| | | | | | |
|---|---|---|---|---|---|
| 36,976 | A | * | 11/1862 | Acker | E05F 1/1215 16/300 |
| 40,879 | A | * | 12/1863 | Bommer | E05F 1/1215 16/300 |
| 233,569 | A | * | 10/1880 | Spruce | 16/307 |
| 277,925 | A | * | 5/1883 | Pfauntz | E05D 3/12 16/366 |
| 393,350 | A | * | 11/1888 | Bartlett | 16/307 |

(Continued)

*Primary Examiner* — Jeffrey O'Brien

(74) *Attorney, Agent, or Firm* — Muncy, Geissler, Olds & Lowe, P.C.

(57) ABSTRACT

A spring hinge base structure is provided, including: a body, having a first tube and a first plate portion; locking units each having a cover and an engagement member, each engagement member being engaged within the cover, two of the locking units being connected to opposite ends of the first tube; an elastic element, engaged with the two locking units; a second plate portion; and a shaft, disposed through the respective cover and respective engagement member, wherein the second plate portion is integral and rotatably movable together with one of the locking units by a bump component and abutted between the second plate portion and one of the locking unit.

14 Claims, 6 Drawing Sheets

(56) References Cited

U.S. PATENT DOCUMENTS 495,966 A * 4/1893 Ennis ..... 16/307
2,520,616 A * 8/1950 Wasson ..... E05F 1/1215 16/300
3,702,491 A * 11/1972 Pelletiere ..... E05F 1/1215 16/301
3,903,567 A * 9/1975 Suska ..... E05F 1/1215 16/301
3,965,533 A * 6/1976 Frohlich ..... E05F 1/1215 16/300
3,978,551 A * 9/1976 Mochizuki ..... E05F 1/1215 16/301
4,073,038 A * 2/1978 Curry ..... E05F 1/1215 16/301
4,102,013 A * 7/1978 Newlon ..... E05D 5/128 16/222
4,141,123 A * 2/1979 Newlon ..... E05D 5/128 29/11
4,339,845 A * 7/1982 Newlon ..... E05F 1/1215 16/300
4,351,085 A * 9/1982 Suska ..... E05D 5/10 16/273
4,419,788 A * 12/1983 Prout ..... E05F 1/1215 16/300
4,583,262 A * 4/1986 Werner ..... E05F 1/1215 16/300
4,756,051 A * 7/1988 Shy ..... E05F 3/14 16/299
4,845,811 A * 7/1989 Fargnier ..... E05F 1/123 16/308
5,048,155 A * 9/1991 Hwang ..... E05F 1/1215 16/301
5,205,015 A * 4/1993 Huang ..... E05F 1/1215 16/297
5,383,253 A * 1/1995 Lin ..... E05F 3/20 16/299
5,572,768 A * 11/1996 Daul ..... E05F 1/1215 16/49
5,584,100 A * 12/1996 Doyle ..... E05F 1/1215 16/301
5,606,774 A * 3/1997 Wu ..... E05D 3/12 16/283
5,651,536 A * 7/1997 Daul ..... E05F 1/1215 267/205
6,256,839 B1 * 7/2001 Wu ..... E05D 3/12 16/283
6,460,220 B1 * 10/2002 Jackson ..... E05F 1/1215 16/285
6,618,902 B2 * 9/2003 Wu ..... E05F 1/1215 16/298
7,278,183 B2 * 10/2007 Schluter ..... E05D 5/121 16/262
7,516,519 B2 * 4/2009 Talpe ..... E05F 1/1215 16/316
8,245,353 B2 * 8/2012 Homner ..... E05F 1/1215 16/299
8,549,707 B2 * 10/2013 Macernis ..... E05F 1/1215 16/301
8,898,860 B2 * 12/2014 Bacchetti ..... E05F 3/20 16/50
8,955,194 B2 * 2/2015 Teta ..... E05F 1/1207 16/48.5
9,206,636 B2 * 12/2015 Nagi ..... E05F 3/20
9,353,563 B2 * 5/2016 Bacchetti ..... E05F 5/06
9,353,564 B2 * 5/2016 Bacchetti ..... E05D 11/084
9,371,676 B2 * 6/2016 Rittenhouse ..... E05D 3/12
9,803,408 B2 * 10/2017 Timothy ..... E05D 7/0009
9,816,303 B2 * 11/2017 Lee ..... E05D 5/0276
9,964,988 B2 * 5/2018 Rittenhouse ..... E05D 3/12
2004/0020011 A1 * 2/2004 Fang ..... E05D 3/08 16/302
2004/0212968 A1 * 10/2004 Lin ..... E05D 3/12 361/755
2005/0241106 A1 * 11/2005 Sosa ..... E05F 1/1215 16/278
2007/0000090 A1 * 1/2007 Wu ..... E05F 1/1215 16/299
2007/0136991 A1 * 6/2007 Huang ..... E05F 1/1215 16/307
2017/0362870 A1 * 12/2017 Vera ..... E05F 1/1215
2018/0363347 A1 * 12/2018 Chang ..... E05F 1/1223
2020/0181964 A1 * 6/2020 Wu ..... E05D 5/14

* cited by examiner

SPRING HINGE BASE STRUCTURE

BACKGROUND OF THE INVENTION

Field of the Invention

The present invention is a CIP of application Ser. No. 16/212,685, filed Dec. 7, 2018, the entire contents of which are hereby incorporated by reference.

Description of the Prior Art

A conventional spring hinge is a simple mechanical device that uses an elastic element such as a spring or elastic piece to generate a torsional force to drive a door leaf to open and close, generally used to cause the door leaf to be closed automatically or to keep the door leaf open. In terms of general spring hinge action, it includes one-way movement of the door leaf and two-way movement of the door leaf Upon use, one leaf of the spring hinge is fixed to a door frame and another leaf thereof the door leaf, and the door leaf can be closed again or kept open after the movement thereof by means of the torsional physical movement generated from the elastic element such as the spring or elastic piece fixed in a hinge tube.

Such kinds of spring hinges are applied to public building fire doors, indoor kitchens, living room compartment doors, outdoor fence doors, etc., and the base for the provision of the torsional movement of the hinge spring or elastic piece is generally purely made of a single material such as copper, aluminum, iron, zinc alloy and plastic fiber by means of die casting, turning, injection, etc. However, the elastic elements such as the clamping springs or elastic piece of the base (including fixation seat and adjustment seat) made of copper, aluminum, iron, zinc alloy and plastic fiber with soft material and low density are easily deformed or severely worn and twisted, further causing the failure of the torsion or the severe weakening of the torsion of the spring or elastic piece of the spring hinge, because they have no sufficient strength to bear the overlarge pressure generated from the high-frequency movement caused by a thick and heavy door leaf.

The spring hinge elastic element base (including fixation seat and adjustment seat) made of copper, aluminum, iron, zinc alloy and plastic fiber cannot bear the high torsional movement of the elastic elements, resulting in the shortened operation life of the spring hinge.

US20070136991 does not provide any disclosure, suggestion or teaching of solving the long-term conventional technical problem by using two separate members to form a combined cover. US20070136991 discloses that the locking unit having a cover and an engagement member is integrally formed of a single material and of one piece. It is noted that in the field of the spring hinge, there is no reasons or motivation to provide the cover and the engagement member in two separate members. In the prior arts, based on considerations of production yield, efficiency and cost, and considerations of consistence of material matching, color and appearance, one skilled in the art would not be motivated to make the cover in two separate members since this can cause low production yield and efficiency, high production cost, and low consistence of material matching, color and appearance. It is unreasonable and incomprehensible how one skilled in the art would construct a cover by two separate members.

The present invention has arisen to mitigate and/or obviate the afore-described disadvantages.

SUMMARY OF THE INVENTION

To overcome the defects mentioned above, the present invention is proposed.

The present invention proposes a spring hinge base structure, including: a body, having a first tube and a first plate portion fixedly connected with the first tube; a plurality of locking units, each having a cover and an engagement member which are two separate members integrally connected with each other, a center of each cover comprising a first through hole, one end of each cover comprising a groove, each first through hole positioned inside the respective groove, each engagement member being engaged inside the respective groove and comprising an engagement groove, a first one of the plurality of locking units being connected to an end of the first tube and movable together with the first tube, a second one of the plurality of locking units being located at another end of the first tube and rotatable with respect to the first tube; an elastic element, two ends thereof respectively engaged with the respective engagement grooves of the first one and the second one of the plurality of locking units; a second plate portion, upper and lower ends of one side thereof respectively projected with a blocking portion, each blocking portion comprising a second through hole; and a shaft, disposed through one said first through hole and one said second through hole, wherein the second plate portion is integral and rotatably movable together with the second one of the plurality of locking units by a bump component which is adjustably connected to the second one of the plurality of locking units and abutted between the second plate portion and the second one of the plurality of locking units.

DETAILED DESCRIPTION OF THE PREFERRED EMBODIMENTS

Figure 1:
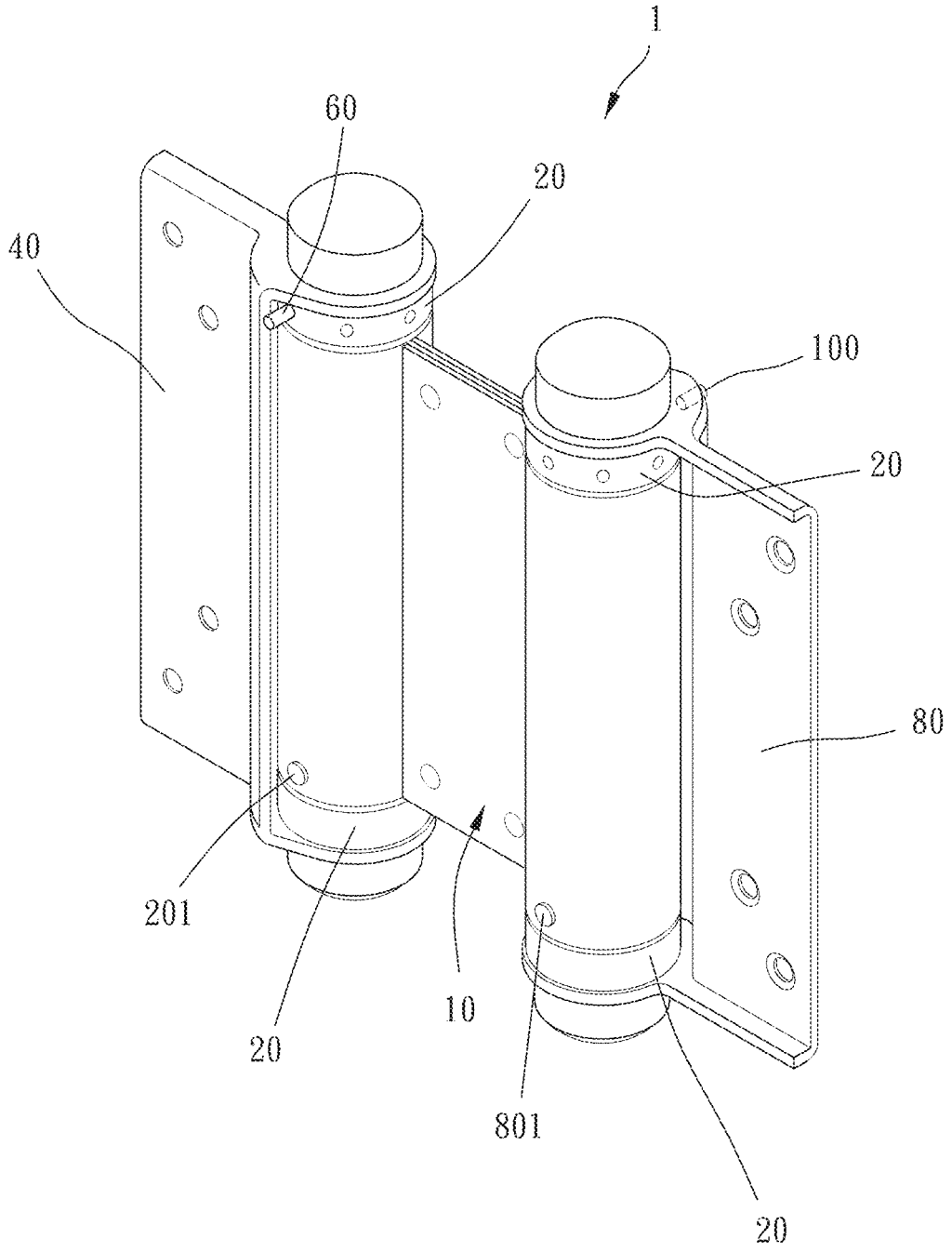
FIG. 1 is a perspective view of the present invention.
Figure 2:
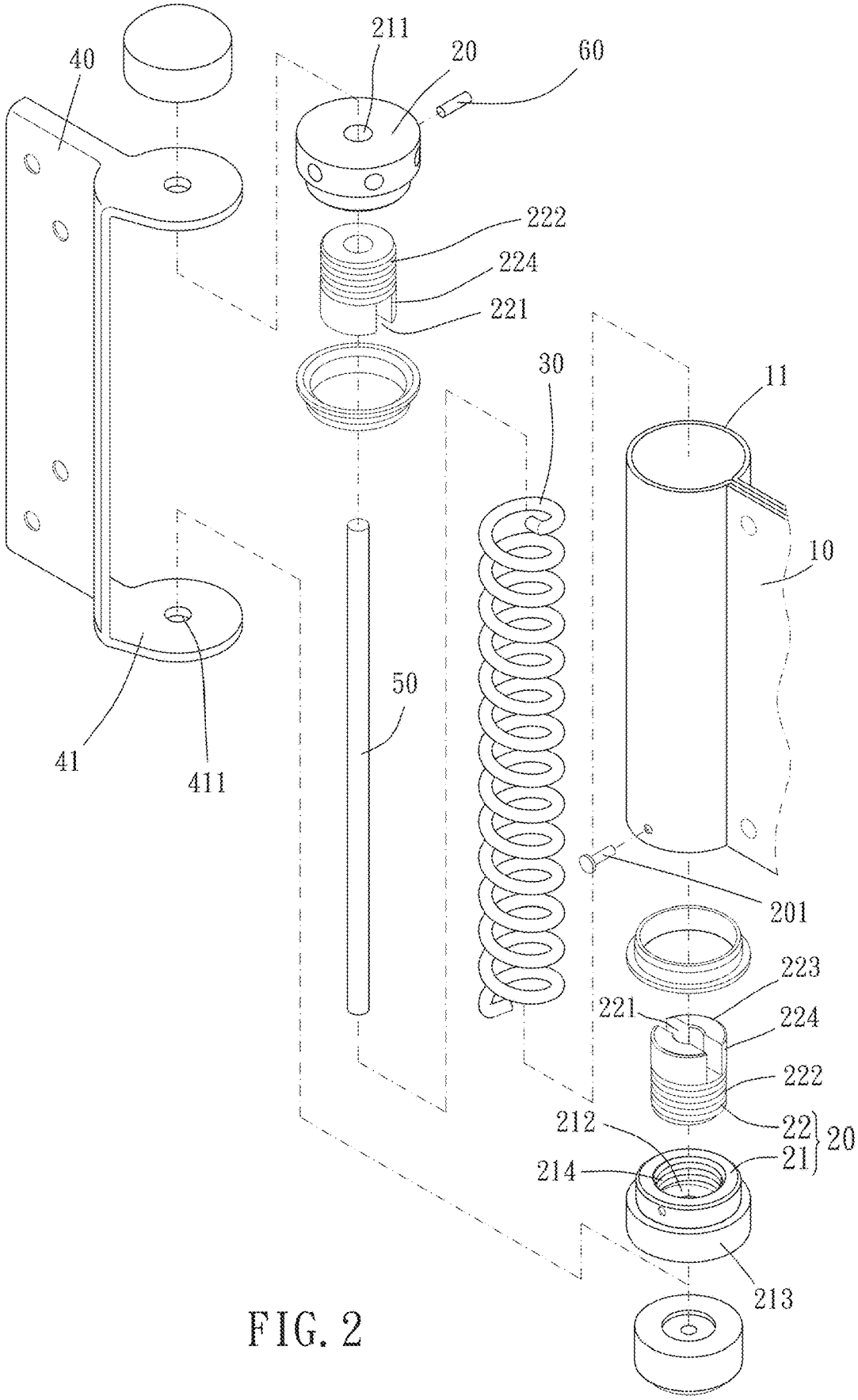
FIG. 2 is a partial exploded view of the present invention.
Figure 3:
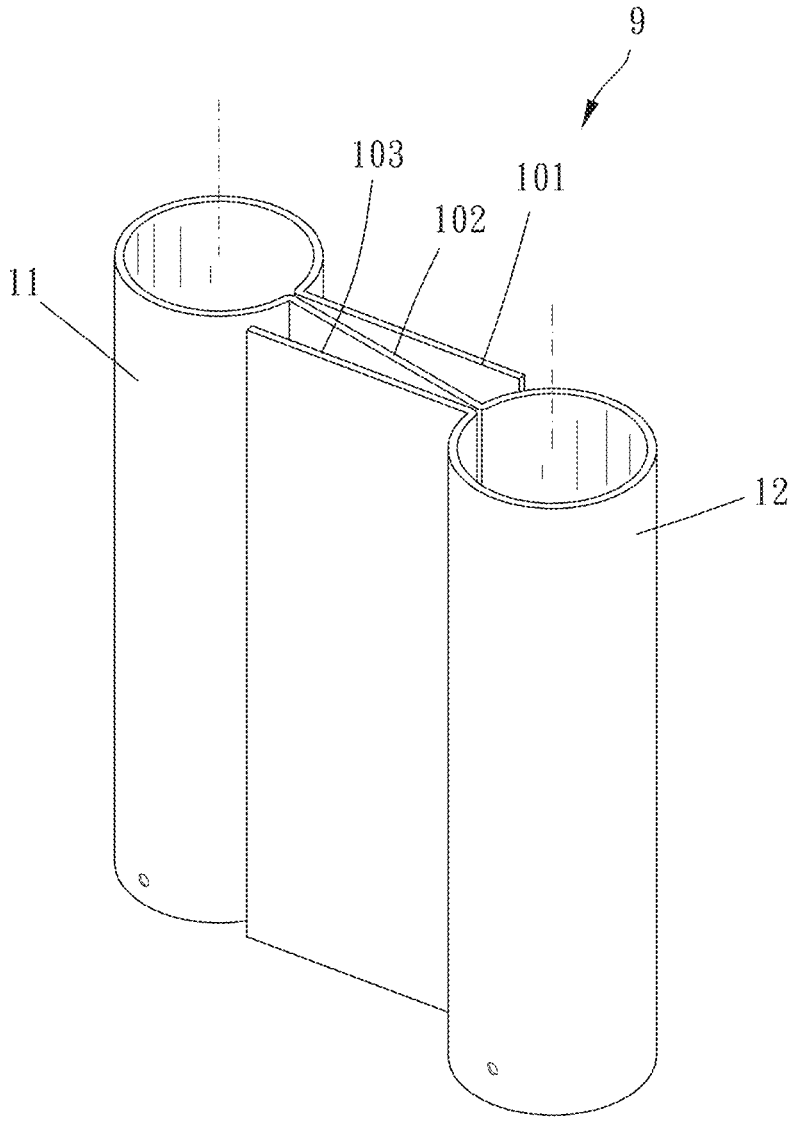
FIGS. 3 and 4 are drawings showing a body of the present invention.
Figure 4:
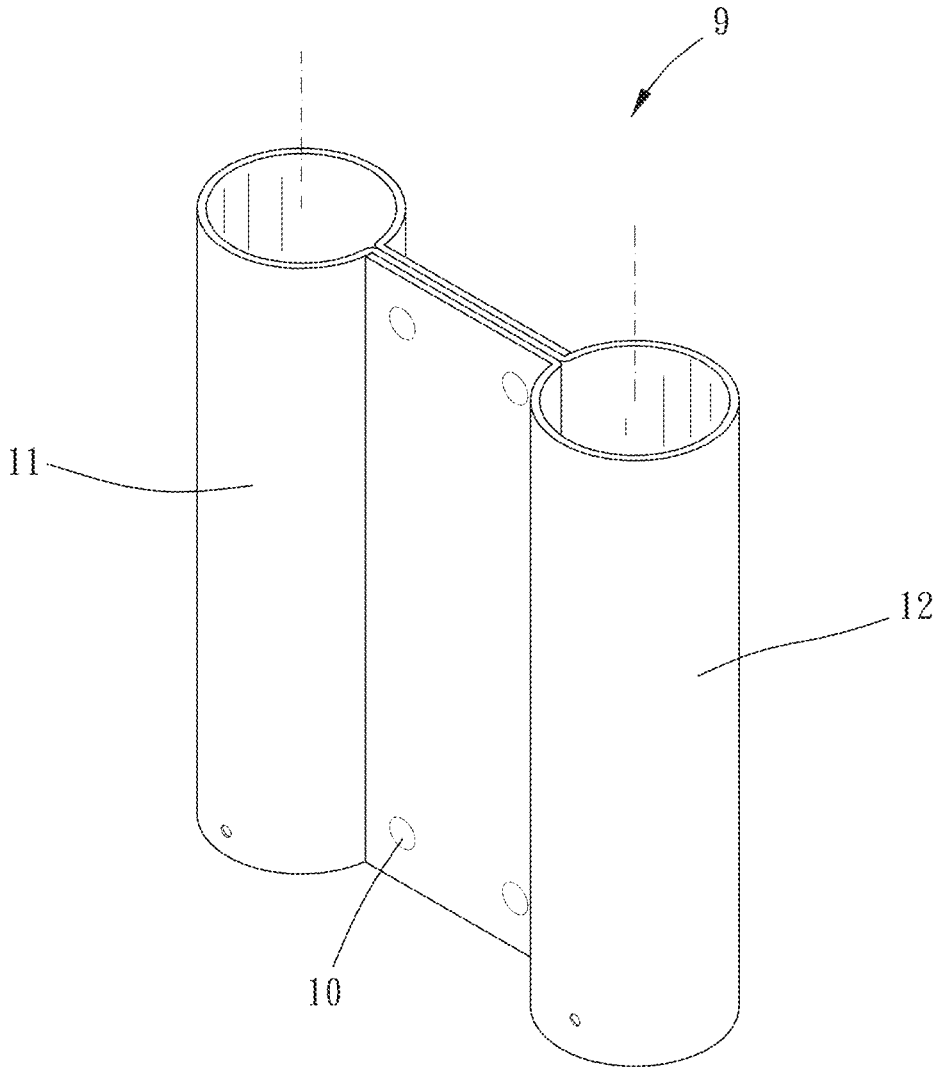
Figure 5:
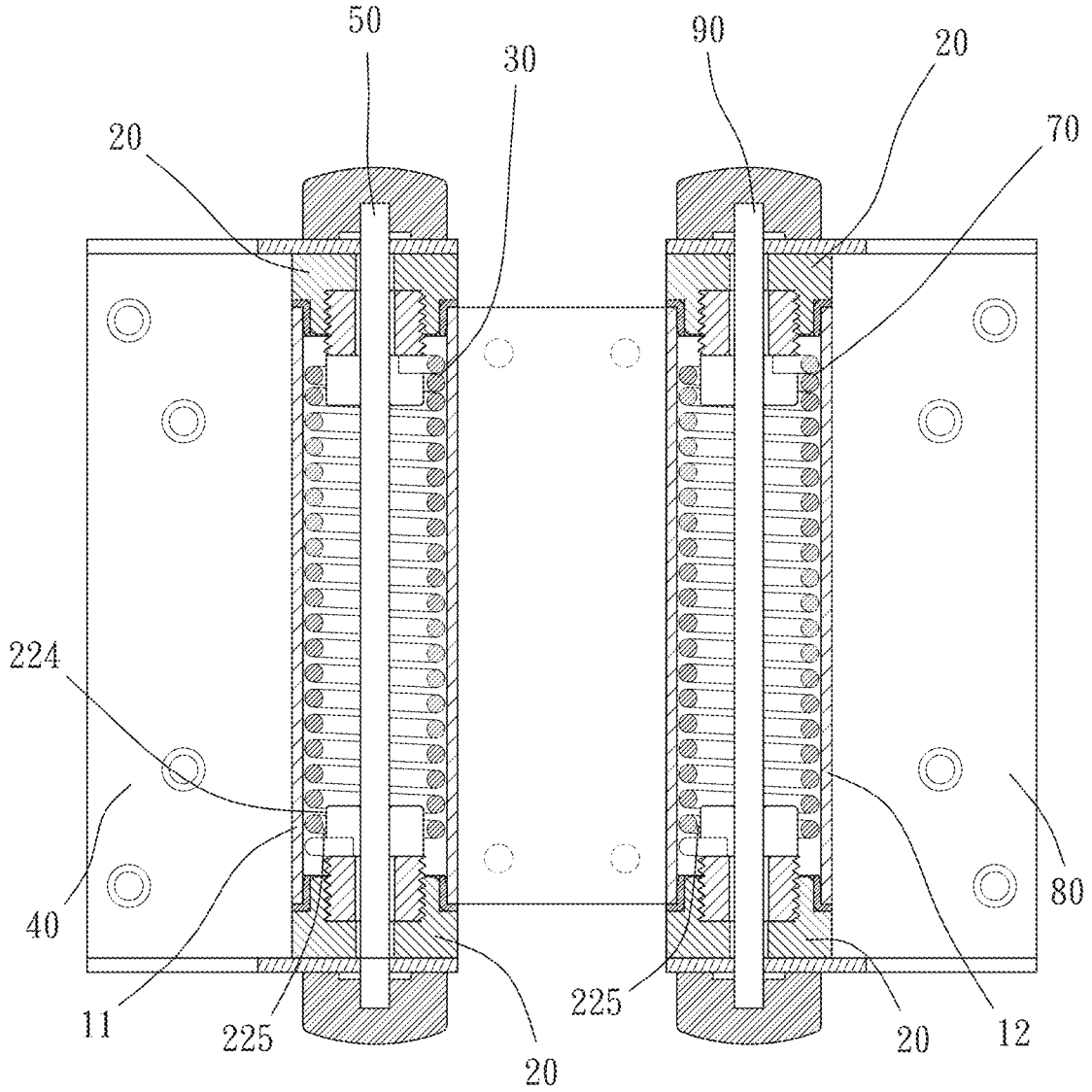
FIG. 5 is a cross-sectional view of the present invention.
Figure 6:
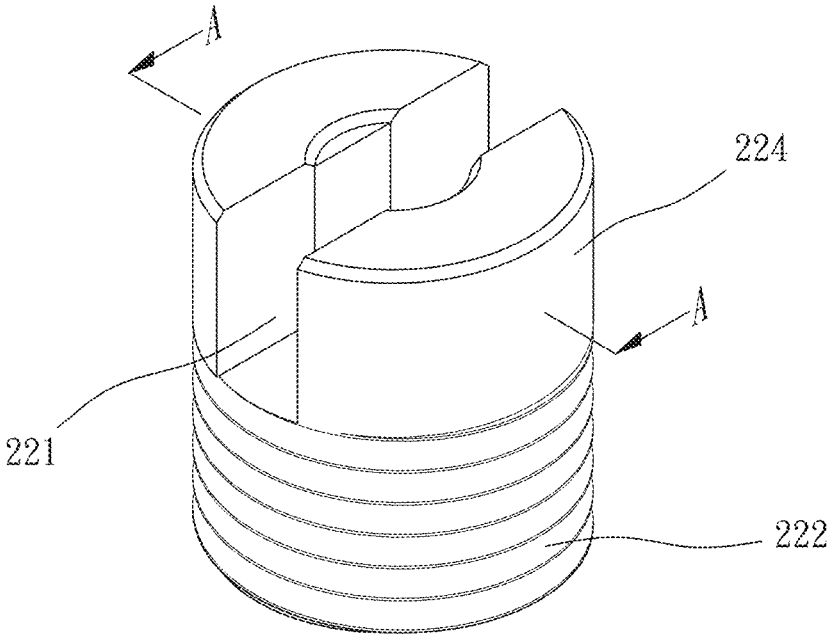
FIG. 6 is a perspective view of an engagement member of the present invention.
Figure 7:
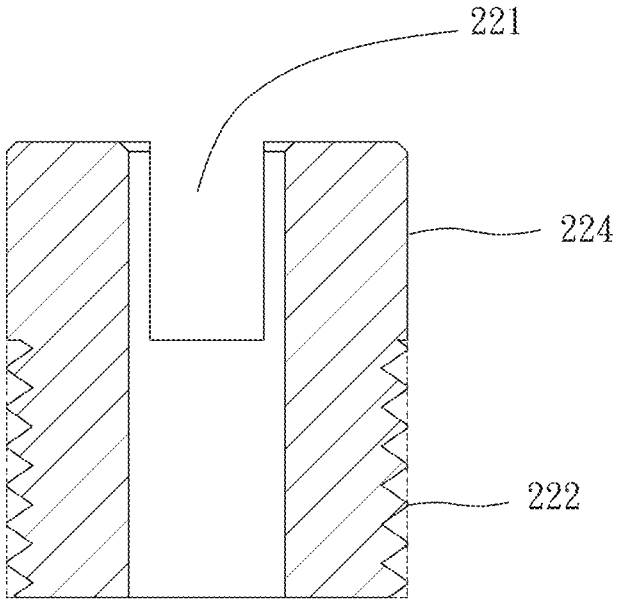
FIG. 7 is a cross-sectional view of the engagement member of the present invention.

Referring to FIGS. 1 to 7, a spring hinge base structure 1 of the present invention includes a body 9 has a first tube 11 and a first plate portion 10 fixedly connected with the first tube 11, a plurality of locking units 20, an elastic element 30 and a second plate portion 40.

Each locking unit 20 has a cover 21 and an engagement members 22 which are two separate members integrally connected with each other; the center of each cover 21 comprises a first through hole 211; one end of each cover 21 comprises a groove 212 where the first through hole 211 is positioned inside. Furthermore, each engagement member 22 is engaged inside of the respective groove 212. Each engagement member 22 is slotted diametrically through the respective engagement member 22 (or the respective engagement member may be slotted, non-diametrically, on the tubular wall) to form an engagement groove 221, which facilitating the engagement of the elastic element 30 to the engagement member 22 and provides various adjustment options for pre-load of elastic force. A first one of the plurality of locking units 20 is fixedly connected, by a pin 201 or the like, to an end of the first tube 11 and movable together with the first tube 11, a second one of the plurality of locking units 20 is located at another end of the first tube 11 and rotatable with respect to the first tube 11.

The top of cover 21 comprises a flange 213 extending annularly and abutted against the end of the first tube 11. Furthermore, the inner wall of the groove 212 of the cover 21 comprises internal threads 214, and one end of the engagement member 22 comprises external threads 222 engaging with the internal threads 214 of the respective cover, thereby allowing the engagement member 22 to be detachably engaged with the groove 212, but the present invention is not limited thereto, the engagement may also be welding, positioning hole riveting, bolt or buckle fastening. Specifically, each engagement member further includes a non-threaded section 224 near the external threads 222, and the respective engagement groove 221 is formed by being slotted from an end of the respective non-threaded section 224. Preferably, the respective engagement groove 221 is entirely within the respective non-threaded section 224. Each of the two ends of the elastic element 30 is sleeved around the respective non-threaded section 224, and the external threads 222 of the respective engagement member 22 are entirely outside the respective non-threaded section 224. Each of the two ends of the elastic element 30 is distanced from the outer circumferential surface 223 of the respective engagement member 22 annularly, to form an annular gap 225. As viewed in an axial direction of the respective engagement member 22, the external threads 222 are entirely within the outer circumferential surface 223 of the respective engagement member 22. As a result, the elastic element 30 cannot be inferenced and affected by the external threads 222 so the elastic element 30 can provide smooth and stable torsion without being stuck or dragged due to contact of the external threads 22 with the coil(s) of the elastic element 30 when wound (shortening) or unwound (elongating).

According various applications, the cover 21 may be made of copper, aluminum, zinc alloy or plastic fiber, and the engagement member may be, for example, made of iron or heat-treated steel and has stiffness and tensile strength higher than the cover. Therefore, the engagement member 22 can bear the high torsional movement of the elastic element 30 without being easily deformed and damaged. Preferably, the first tube 11 and each cover 21 are made of the same material. Each cover 21 and the respective engagement member 22 are two separate members which are integrally connected with each other and which are detachably assembled. Preferably, the first tube and each cover are made of the same material.

The two ends of the elastic element 30 are respectively engaged with the respective engagement grooves 221 of the first one and the second one of the plurality of locking units 20, where the elastic element 30 may be a spring or any elastic piece.

The upper and lower sides of one side of the second plate portion 40 are respectively projected with a blocking portion 41 comprising a second through hole 411; each blocking portion 41 is abutted against the outer side of the cover 21, allowing each second through hole 411 to be in communication with the corresponding first through hole 211.

A shaft 50 is disposed through one said first through hole 211 and one said second through hole 411. The second plate portion 40 is integral and rotatably movable together with the second one of the plurality of locking units 20 by a bump component 60 which is adjustably connected to the second one of the plurality of locking units 20 and abutted between the second plate portion 40 and the second one of the plurality of locking units 20.

In this embodiment, the spring hinge base structure 1 further includes a second elastic element 70, a third plate portion 80 and a second shaft 90. The body 9 is integrally formed of one piece and further includes a second tube 12, the first plate portion 10 is connected between the first tube 11 and the second tube 12, a third one of the plurality of locking units 20 is fixedly connected, by a pin 801 or the like, to an end of the second tube 12 and movable together with the second tube 12, a fourth one of the plurality of locking units 20 is located at another end of the second tube 12 and rotatable with respect to the second tube 12, two ends of the second elastic element 70 are respectively engaged with the respective engagement grooves 221 of the third one and the fourth one of the plurality of locking units 20, the second shaft 90 is disposed through one said first through hole and a respective end of the third plate portion 80, and the third plate portion 80 is integral and rotatably movable together with the fourth one of the plurality of locking units 20 by a second bump component 100 which is adjustably connected to the fourth one of the plurality of locking units 20 and abutted between the third plate portion 80 and the fourth one of the plurality of locking units 20. The body 9 is formed from a single sheet member, the first plate portion 10 includes a first end plate 101, an intermediate plate 102 and a second end plate 103, the first tube 11 integrally extends from a side of the first end plate 101, the intermediate plate 102 integrally extends between and connects the first tube 11 and the second tube 12, the second end plate 103 integrally extends from the second tube 12, and the intermediate plate 102 is fixedly connected with and between the first end plate 10 and the second end plate 103 by welding, positioning hole riveting, bolt or buckle fastening. The first end plate 101, the intermediate plate 102 and the second end plate 103 preferably have substantially the same width between the first tube 11 and the second tube 12, thus providing good structural strength. Preferably, the respective outer circumferential surface 223 is threaded from an end periphery thereof to a bottom of the respective engagement groove 221. Alternatively, the outer circumferential surface may be threaded from end to end. This improves engagement, provides higher stiffness and tensile strength, and is easy to assemble/disassemble, for the engagement member and the cover.

To sum up, the spring hinge base structure of the present invention can have a higher bearing performance and strength against high-pressure torsional movement because of the combination structure of the cover with engagement member and the use of different materials.

While we have shown and described various embodiments in accordance with the present invention, it should be clear to those skilled in the art that further embodiments may be made without departing from the scope of the present invention.

What is claimed is:

1. A spring hinge base structure, comprising:

a body, having a first tube and a first plate portion fixedly connected with the first tube;

a plurality of locking units, each having a cover and an engagement member which are two separate members integrally connected with each other, a center of each cover comprising a first through hole, one end of each cover comprising a groove, each first through hole positioned inside the respective groove, each engagement member being engaged inside the respective groove and comprising an engagement groove, a first one of the plurality of locking units being connected to an end of the first tube and movable together with the first tube, a second one of the plurality of locking units being located at another end of the first tube and rotatable with respect to the first tube;

an elastic element, two ends thereof respectively engaged with the respective engagement grooves of the first one and the second one of the plurality of locking units; a second plate portion, upper and lower ends of one side thereof respectively projected with a blocking portion, each blocking portion comprising a second through hole; and a shaft, disposed through one said first through hole and one said second through hole, wherein the second plate portion is integral and rotatably movable together with the second one of the plurality of locking units by a bump component which is adjustably connected to the second one of the plurality of locking units and abutted between the second plate portion and the second one of the plurality of locking units, wherein the spring hinge base structure further includes a second elastic element, a third plate portion and a second shaft, the body is integrally formed of one piece and further includes a second tube, the first plate portion is connected between the first tube and the second tube, a third one of the plurality of locking units is connected to an end of the second tube and movable together with the second tube, a fourth one of the plurality of locking units is located at another end of the second tube and rotatable with respect to the second tube, two ends of the second elastic element are respectively engaged with the respective engagement grooves of the third one and the fourth one of the plurality of locking units, the second shaft is disposed through one said first through hole and a respective end of the third plate portion, and the third plate portion is integral and rotatably movable together with the fourth one of the plurality of locking units by a second bump component which is adjustably connected to the fourth one of the plurality of locking units and abutted between the third plate portion and the fourth one of the plurality of locking units, wherein the body is formed from a single sheet member, the first plate portion includes a first end plate, an intermediate plate and a second end plate, the first tube integrally extends from a side of the first end plate, the intermediate plate integrally extends between and is connected directly with the first tube and the second tube, the second end plate integrally extends from the second tube, and the intermediate plate fixedly connected with and between the first end plate and the second end plate in a thicknesswise direction of the intermediate plate, wherein the first end plate, the intermediate plate and the second end plate have substantially the same width between the first tube and the second tube, and wherein the first end plate and the second end plate are parallel to the intermediate plate and respectively stacked on two opposite faces of the intermediate plate in the thicknesswise direction of the intermediate plate.

2. The structure according to claim 1, wherein an inner wall of the respective groove of each cover comprises internal threads, and one end of each engagement member comprises external threads engaging with the internal threads of the respective cover.

3. The structure according to claim 1, wherein a top portion of each cover comprises a flange extending annularly, and the respective end of the first tube is abutted against one said flange.

4. The structure according to claim 1, wherein each cover is made of copper, aluminum, zinc alloy or plastic fiber, and each engagement member has stiffness and tensile strength higher than the respective cover.

5. The structure according to claim 4, wherein the first tube and each cover are made of the same material.

6. The structure according to claim 1, wherein each cover and the respective engagement member are two separate members which are detachably assembled.

7. The structure according to claim 1, wherein each engagement member further includes an outer circumferential surface on which a respective one of the engagement grooves is open.

8. The structure according to claim 7, wherein the respective outer circumferential surface is threaded from an end periphery thereof to a bottom of the respective engagement groove.

9. The structure according to claim 1, wherein each engagement member is slotted diametrically through the respective engagement member to form the respective engagement groove.

10. The structure according to claim 1, wherein an inner wall of the respective groove of each cover comprises internal threads, each engagement member further includes an outer circumferential surface which includes external threads at one end for engagement with the internal threads of the respective cover and includes a non-threaded section near the external threads, and the respective engagement groove is formed by being slotted from the respective non-threaded section.

11. The structure according to claim 10, wherein the respective engagement groove is entirely within the respective non-threaded section.

12. The structure according to claim 11, wherein each of the two ends of the elastic element is sleeved around the respective non-threaded section, and the external threads of the respective engagement member are entirely outside the respective non-threaded section.

13. The structure according to claim 10, wherein each of the two ends of the elastic element is distanced from the outer circumferential surface of the respective engagement member annularly.

14. The structure according to claim 10, wherein as viewed in an axial direction of the respective engagement member, the external threads are entirely within the outer circumferential surface of the respective engagement member.

* * * * *